US006132351A

United States Patent [19]

Lotto et al.

[11] Patent Number: 6,132,351

[45] Date of Patent: Oct. 17, 2000

[54] METHOD AND APPARATUS FOR MAKING INTERNALLY-REINFORCED BAG ASSEMBLY

[75] Inventors: Ronald L. Lotto, Cecil; Scott Romenesko, Green Bay; Peter Hatchell, New Franken, all of Wis.

[73] Assignee: The Hudson-Sharp Machine Co., Green Bay, Wis.

[21] Appl. No.: 09/322,361

[22] Filed: May 28, 1999

[51] Int. Cl.[7] ..... B31B 1/60

[52] U.S. Cl. ..... 493/210; 493/374; 493/379

[58] Field of Search ..... 493/186, 189, 493/231, 210, 243, 311, 374, 379

[56] References Cited

U.S. PATENT DOCUMENTS 4,170,347 10/1979 Lewis .
4,906,228 3/1990 Reifenhauser et al. .
4,927,037 5/1990 Boots .
5,071,025 12/1991 Boots .
5,102,384 4/1992 Ross et al. .
5,246,416 9/1993 Demura et al. .
5,389,188 2/1995 Hicks .

*Primary Examiner*—Eugene Kim
*Attorney, Agent, or Firm*—Rockey, Milnamow & Katz, Ltd.

[57] ABSTRACT

A process for making an internally-reinforced bag assembly includes formation of an outer bag body with a plurality of longitudinally oriented, laterally spaced pleats or tucks therein. An inner reinforcement layer is applied to the outer bag body after formation of the pleats, whereby the inner layer spans and overlaps each of the pleats. An apparatus embodying the present invention effects bag formation in this fashion. Advancement through the forming apparatus effects formation of the outer web into a gusseted tube, and formation of a square bottom seal. The completed bag assembly includes the inner reinforcement layer, which is dimensioned to define a circumference which is less than a circumference defined by the bag body. The resultant bag assembly resists bulging and deformation under the influence of particulate, granular, or other flowable products packaged therein.

19 Claims, 8 Drawing Sheets

METHOD AND APPARATUS FOR MAKING INTERNALLY-REINFORCED BAG ASSEMBLY

TECHNICAL FIELD

The present invention relates generally to a method and apparatus for making an internally-reinforced bag assembly, and more particularly to a method and apparatus for making a bag assembly including an outer bag body having a plurality of longitudinal pleats or tucks, with an inner reinforcement layer joined to the bag body so that the inner layer spans the pleats, whereby the inner layer defines a circumference less than a circumference defined by the bag body.

BACKGROUND OF THE INVENTION

Bag-type packages have found widespread use for packaging of particulate and granular material, such as pet food, fertilizer, granular absorbents, and other diverse products. One typical instruction includes longitudinally extending gussets formed at opposite sides of the bag. A so-called square bottom seal, comprising a V-shaped seal which joins each of a front and rear wall of the bag body to a respective layer of each of the gussets, permits the bag to assume a generally rectangular configuration (with one end open) by permitting each of the gussets to open and unfold substantially along the length of the bag.

While the square bottom seal provided at the lower extent of the above-described bag generally forms and shapes the bottom of the bag to a rectangular configuration, the outer walls of the bag body will typically bulge outwardly to a round configuration under the influence of the pressure of product within the bag. This typical bulging can inhibit efficient handling and storage of filled packages, since each package tends to assume a generally outwardly bulged configuration.

Heretofore, efforts have been made to limit such outward bulging of package assemblies by providing an internal reinforcement layer which defines an effective circumference which is less than an effective circumference defined by an outer layer of the package assembly. U.S. Pat. No. 4,834,255, No. 4,927,037, and No. 5,071,025, all hereby incorporated by reference, illustrate various packaging constructions including inner and outer layers which respectively define differing peripheral dimensions.

The present invention is directed to a method and apparatus for highly efficient manufacture of a flexible bag assembly, including inner and outer layers, wherein the inner layer defines a circumference which is less than a circumference defined by the outer layer. As a consequence, a flexible package is formed which tends to assume and maintain a generally rectangular configuration, thus facilitating palletizing, and shipment and storage of particulate, granular, or other flowable materials for which the bag assembly is suited for use.

SUMMARY OF THE INVENTION

The present invention is directed to a method and apparatus for effecting efficient, high-speed manufacture of internally-reinforced bag assemblies, which are particularly suited for use for packaging of granular, particulate, or like flowable materials. Depending upon material selection, the present bag assembly can be configured for storage of liquid and semi-liquid products. Because the bag assembly tends to assume a "stand-up", upright orientation, the assembly is sometimes referred to as a supported inner-wall bag.

Manufacture of the present bag assembly is facilitated by providing a first web of bag-making material for formation of the body of the bag assembly. At least one, and preferably a plurality of longitudinal pleats are formed in the first web, with a second web of material, forming an inner reinforcement layer, thereafter joined to the first web. The second web is joined such that it spans and overlaps the longitudinal pleats formed in the first web, with the composite assembly thereafter formed into a gusseted tube, and preferably provided with a square bottom seal at the lower extent thereof. The resultant package is configured such that the inner reinforcement layer spans each of the pleats or tucks formed in the outer bag body, whereby the inner layer defines a circumference which is less than a circumference defined by the bag body. The disclosed apparatus provides an efficient arrangement for practicing the present method, including suitable drives for intermittently advancing webs of material through the apparatus for bag manufacture.

In accordance with the present process, a first web of bag-making material (such as plastic film) is provided for formation of a bag body of the bag assembly. A second web of bag making material (which may also comprise plastic film) is provided for formation of an inner reinforcement layer of the assembly, with the preferred embodiment including severing a portion of the second web from the remainder thereof so that the portion of the second web which forms the inner reinforcement layer has a length less than the length of the bag body formed by the first web.

In order to obtain a bag assembly configured in accordance with the present invention, wherein the inner reinforcement layer is joined to each of the walls of the bag body and defines a circumference which is less than a circumference defined by the outer bag body, the present method contemplates that at least one, and preferably a plurality, of laterally spaced, longitudinally oriented pleats are formed in the first web of material. The present apparatus includes a pleat-forming, or "tuck-and-roll" mechanism for efficiently forming the plurality of laterally-spaced, longitudinally extending pleats in the first web.

After pleat formation, the portion of the second web of material is applied to the first web of material so that the second web spans each of the pleats in the first web. The applying step can advantageously be practiced by electrostatically maintaining the portion of the second web in position on the first web, and thereafter joining the portion to the first web, preferably as by heat-sealing. The webs can otherwise be joined such as by use of suitable adhesives.

After the portion of the second web, which forms the inner reinforcement layer, has been applied to the first web, the opposite longitudinal edges of the first web are joined to each other to form a tube having a longitudinal seam. As will be appreciated, the portion of the second web which forms the inner reinforcement layer is positioned on the inside of the tube. The process is completed by forming a seal across the tube to form one end of the bag assembly, and cutting the tube to separate the bag assembly therefrom, with the portion of the second web providing internal reinforcement of the bag body formed from the first web of material.

As noted, the present process preferably includes formation of a plurality of longitudinally oriented, laterally spaced apart pleats, with the step of applying the portion of the second web including joining the second web to the first web at least between adjacent ones of the pleats. More preferably, the portion of the second web is joined to the first web by joining the portion to the first web on laterally opposite sides of each of the longitudinally oriented pleats. It is preferred that the portion of the second web which forms the inner layer of the bag assembly has a width less than the width of the first web from which the bag body is formed so that the longitudinal seam of the bag body, where the longitudinal edges of the first web are joined, only includes two layers of the first web of material. High speed manufacture is thus facilitated.

While it is possible to configure the bag assembly such that the inner reinforcement layer extends the full length of the assembly, it is preferred that the portion of the second web which forms the inner layer has a length less than the length of the bag body formed from the first web. This is achieved by severing the portion of the second web from the remainder of the second web prior to application of the portion to the first web.

Preferred features of the present method include the formation of a pair of gussets in the tube prior to the formation of a seal there across. Additionally, it is preferred that this seal be provided in the form of a square bottom seal formed by a V-shaped seal between each of a front and rear wall of the bag assembly, and a respective layer of each of the gussets. Tube formation is facilitated by the provision of a tube-forming box assembly, with the first web guided about the internal forming box of the assembly so that the portion of the second web closely conforms to the exterior of the forming box.

The apparatus for practicing the present method includes a first web-supplying mechanism for supplying a first web of material for formation of the body of the bag assembly, and a second web-supplying mechanism for supplying the second web for formation of the inner reinforcement layer. A pleat-forming mechanism is provided along which the first web is moved for formation of at least one, and preferably a plurality, of longitudinal pleats in the first web. The apparatus includes an application station for applying a portion of the second web to the first web so that the second web spans the pleats in the first web. The forming box assembly forms the first web into the tube, with the portion of the second web being positioned on the inside of the tube. A sealing mechanism joins opposite, longitudinal edges of the first web to each other to form a longitudinal seam in the tube, with a sealer forming a seal across the tube, and a cutter provided for separating the bag assembly from the tube.

The apparatus includes a plurality of drive mechanisms operable in concert with each other for intermittently advancing the first web of material through the apparatus. The pleat-forming mechanism of the apparatus includes a plurality of laterally spaced, pleat-forming members, preferably each comprising a free-wheeling wheel or disc. Notably, the pleat-forming mechanism includes an upstream pair of the pleat-forming members, and two downstream pairs of the pleat-forming members. The upstream pair first form a pair of laterally inner pleats in the first web. An inner pair of the downstream members maintain the inner pleats, with an outer pair of the downstream members forming a pair of laterally outer pleats in the first web. Thus, in accordance with the preferred form, four longitudinally extending pleats are formed in the first web, each of which is spanned by the inner reinforcement layer applied to the first web. The resultant bag assembly has a generally rectangular cross-section.

The application station of the apparatus includes at least one heat-sealer for joining the severed portion of the second web to the first web on laterally opposite sides of each of the longitudinally-oriented pleats, with an inner layer cutter provided for severing portions of the second web for application to the first web. An electrostatic discharge apparatus electrostatically treats the first web for maintaining each severed portion of the second web in position on the first web prior to heat-sealing to the first web. This desirably acts to maintain the severed portion of the second web in position on the first web as the first web is intermittently advanced through the apparatus.

Other features and advantages of the present invention will become readily apparent from the following detailed description, the accompanying drawings, and the appended claims.

DETAILED DESCRIPTION

Figure 1:
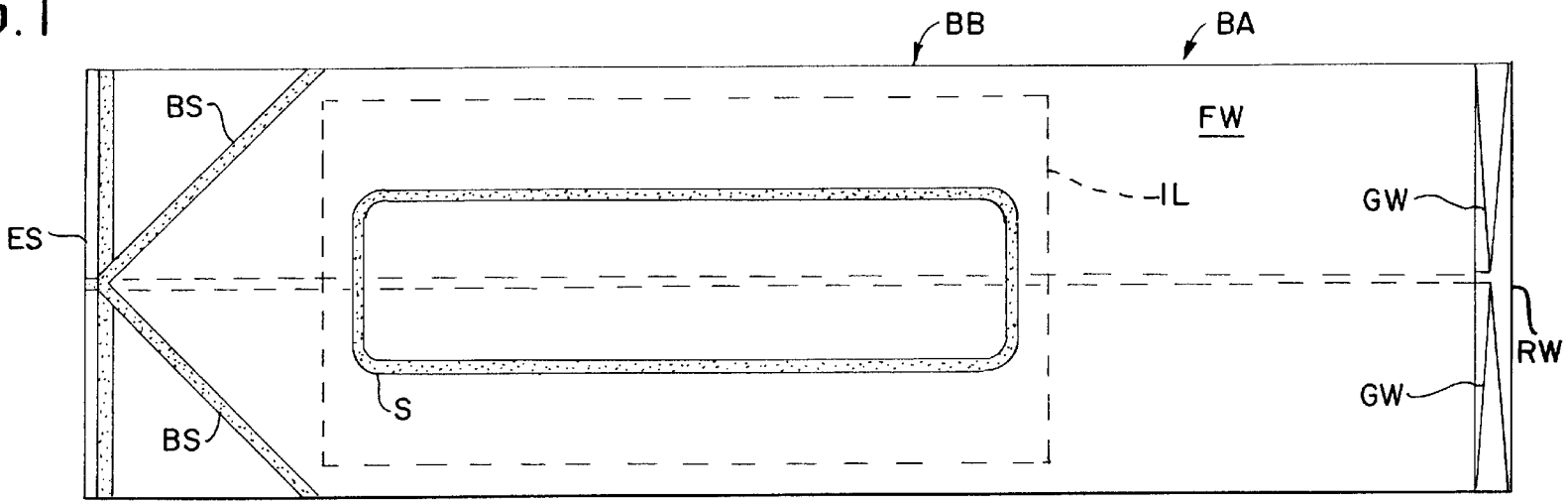
FIG. 1 is a diagrammatic, top plan view of an internally-reinforced bag assembly embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Figure 2:
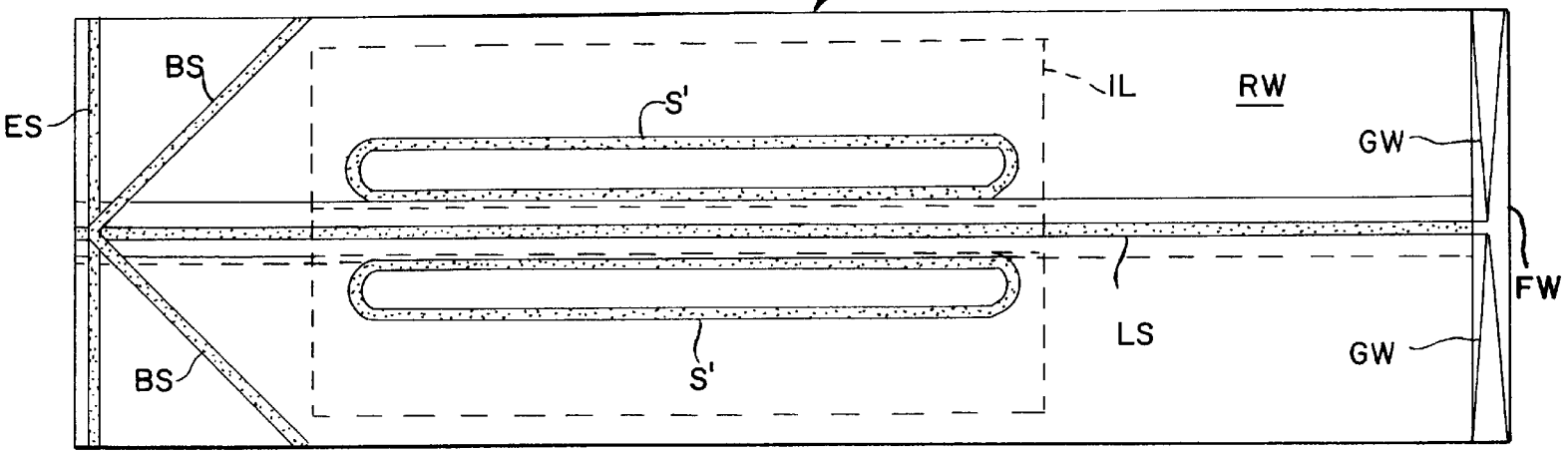
FIG. 2 is a diagrammatic, bottom plan view of the bag assembly shown in FIG. 1.
Figure 1A:
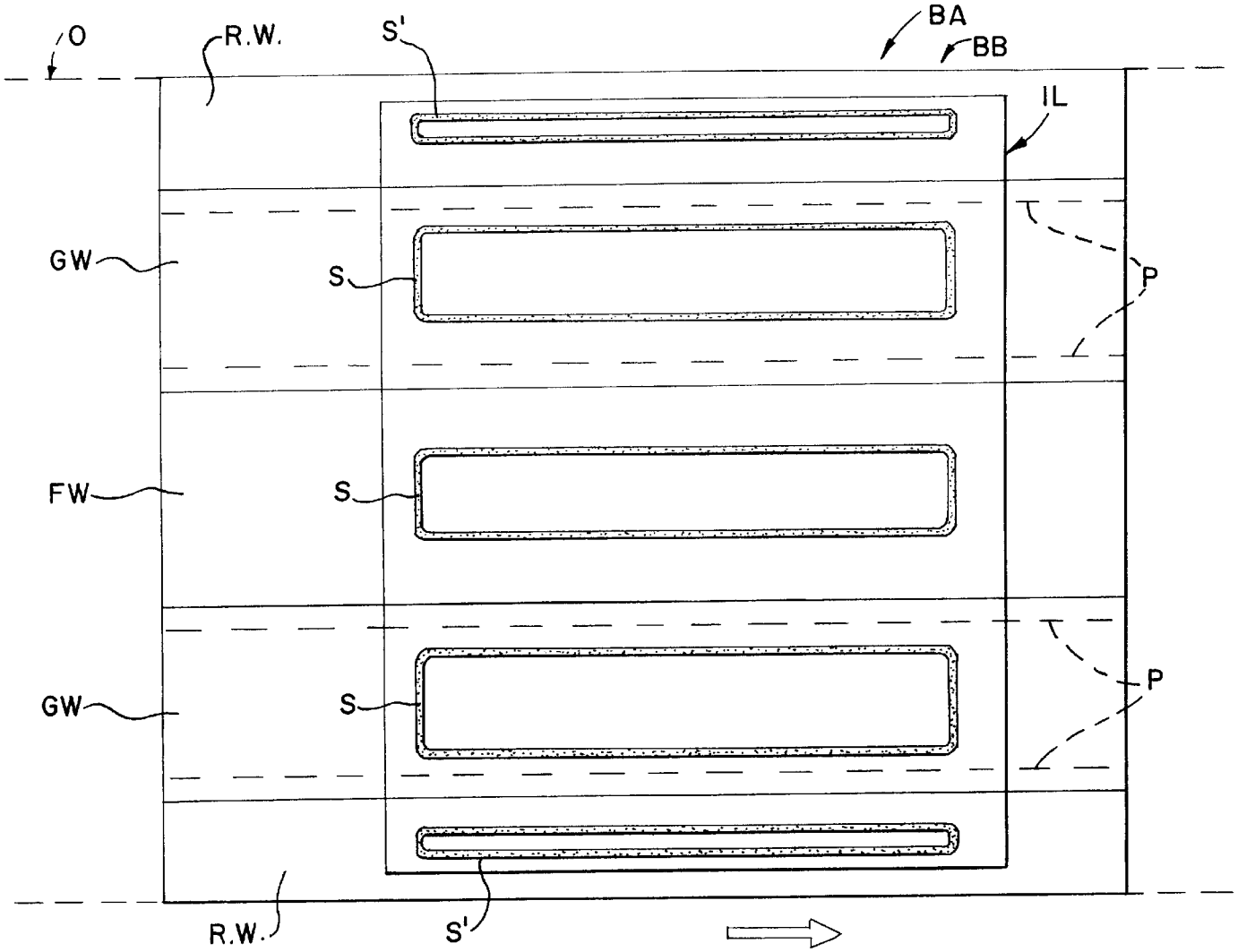
FIG. 1*a* is a diagrammatic view illustrating a portion of an outer web of material which forms a bag body of the bag assembly shown in FIG. 1, and further illustrating a portion of a second web of material which forms an inner reinforcement layer of the bag assembly shown in FIG. 1.

With reference first to FIGS. 1, 1*a*, and 2, therein is diagrammatically illustrated a bag assembly BA configured in accordance with the present invention. The bag assembly is of the so-called gusseted type, including a pair of laterally opposite, longitudinally extending gussets which permit the bag to be stored in a flattened condition, and opened to an expanded condition for packaging flowable product therein.

The bag assembly is internally-reinforced, and to this end, includes an outer bag body BB, and an inner reinforcement layer IL. The bag body includes longitudinal seal LS at a rear wall RW thereof, with the longitudinal seam formed by joining the laterally opposite longitudinal edges of a first, outer web of material, designated O, from which the bag body is formed. The bag body further includes a front wall FW, and a pair of inwardly folded gusset walls GW which extend between respective opposite edges of the front and rear walls.

The inner reinforcement layer IL, formed from a second web of material designated I (FIG. 3) preferably has a length which is less than the length of the bag body. It is preferred that the inner layer IL has a width less than the width of the first web from which the bag body is formed so that the longitudinal seam of the bag body only includes two layers of the first web of material, thus facilitating high-speed manufacture by avoiding the need to seal through two layers of the outer web, and two layers of the inner web.

In accordance with the present invention, the inner reinforcement layer defines a circumference which is less than a circumferences defined by the outer bag body, thus providing a package which resists bulging under the influence of product packaged therein. To achieve this, the bag body is formed with a plurality of laterally spaced, longitudinally extending tucks or pleats P. Each longitudinal pleat is provided at the juncture of each adjacent pair of walls of the bag body. It is preferred that the laterally inner pair of pleats P are formed to extend generally away from the centerline of the first web of material, while the laterally outer pair of longitudinal pleats P are formed to extend generally toward the centerline.

The inner layer of reinforcing material is applied to the first web such that the inner layer spans each of the longitudinal pleats P. In this manner, upon formation of the bag body, including formation into a tube and formation of an end seal, the inner reinforcement layer defines a circumference which is less than a circumference defined by the bag body. Preferably, the portion of the second web which forms the inner reinforcing layer is joined, such as by heat sealing, to the outer first web between each adjacent pair of pleats P, by the provision of generally oval or racetrack-shaped seals S. Most preferably, the inner layer IL is joined to the outer bag body on opposite sides of each of the pleats P. To this end, relatively narrow heat-seals S' are preferably provided for joining the inner layer to each of the portions of the outer web which together define the rear wall RW of the bag body. As noted, the longitudinal seam LS of the bag body is preferably formed by joining the laterally opposite longitudinal edges of the outer first web, without portions of the inner layer being joined in the longitudinal seal. The provision of the relatively narrow heat-seals S', inwardly of the longitudinal edges of the inner layer and outer bag body, facilitates formation in this fashion.

With further reference to FIGS. 1 and 2, the bag body is preferably provided with a cross seal or end seal ES which extends across the generally tubular structure which forms the bag body. In the preferred form, the bag body is provided with a so-called square bottom seal BS extending across the bag body. The square bottom seal is provided in the form of a pair of V-shaped seals, one between each of the front wall and rear wall of the bag assembly, and a respective layer of each of the gussets of the assembly. Thus, the two V-shaped bottom seals do not join the folded portions of each gusset wall to each other. Upon opening of the bag body, this configuration of the square bottom seal permits opening of the gusset walls away from each other, with the bottom of the bag body thus provided with the desired square bottom seal, as will be recognized by those familiar with the art.

Figure 3:
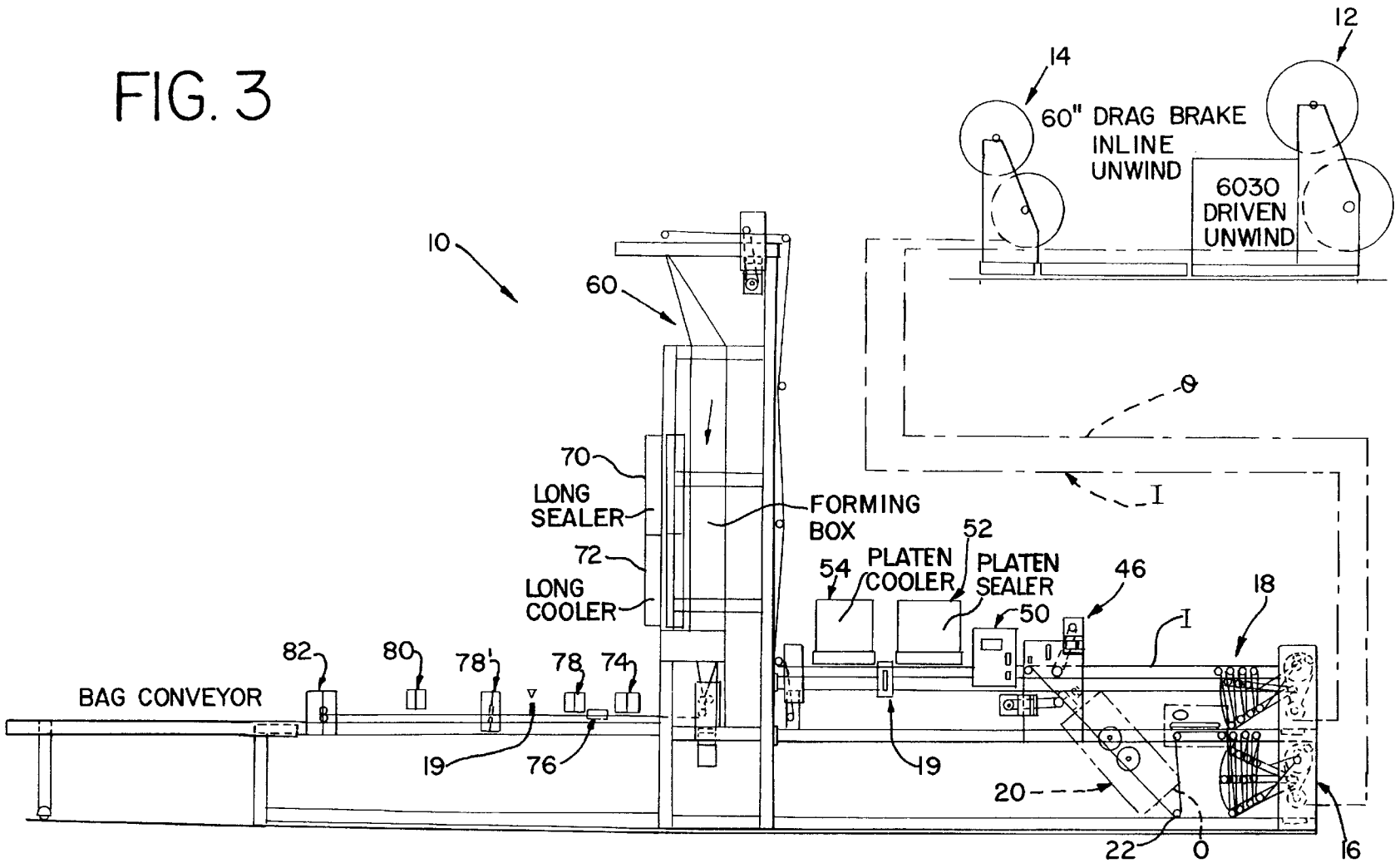
FIG. 3 is a diagrammatic view of an apparatus for making an internally-reinforced bag assembly in accordance with the present invention.
Figure 4:
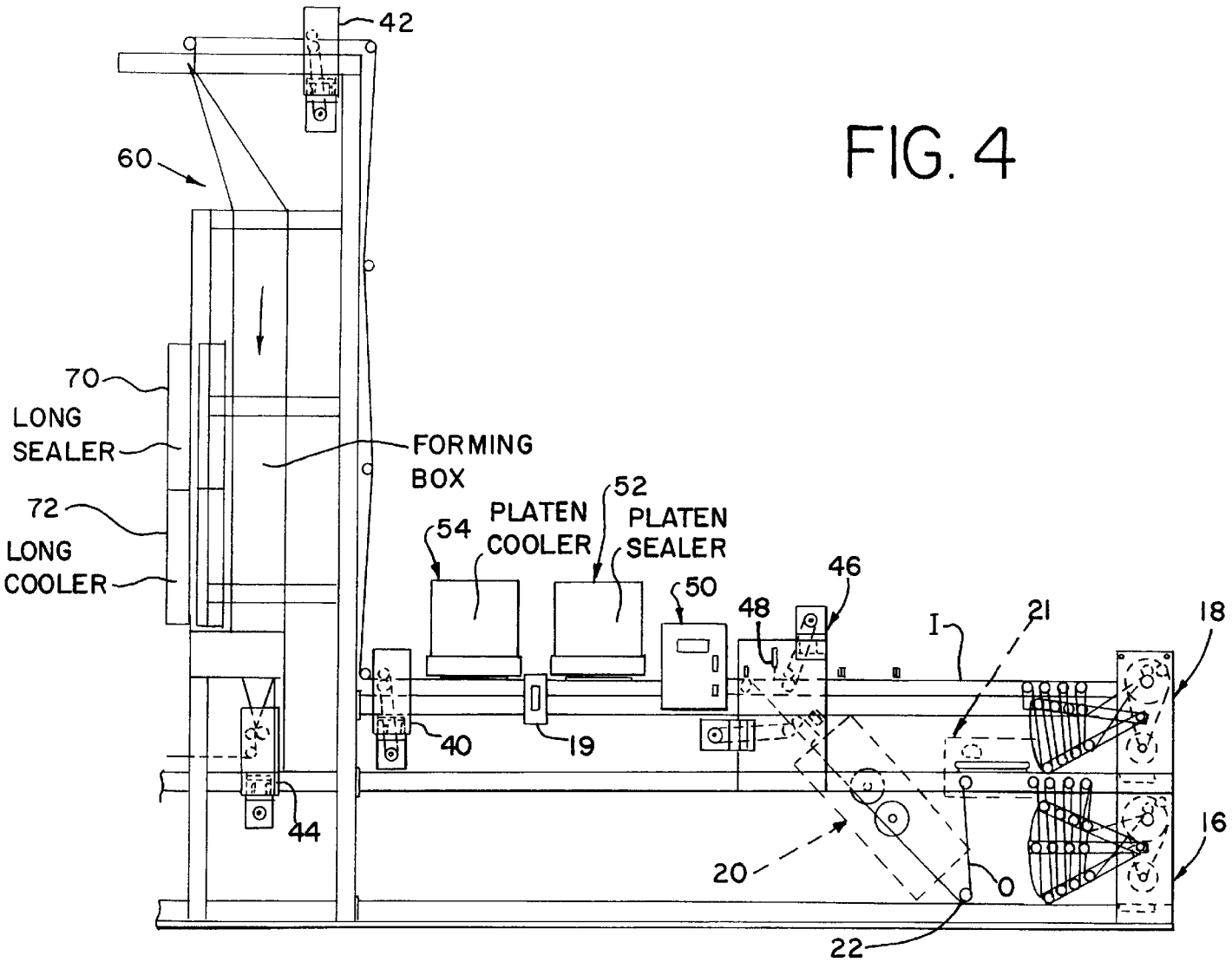
FIG. 4 is a further view of the present apparatus, illustrating portions of the apparatus which effect pleating or tucking of a first web of material, and application of a portion of a second web of material to the first web.
Figure 5:
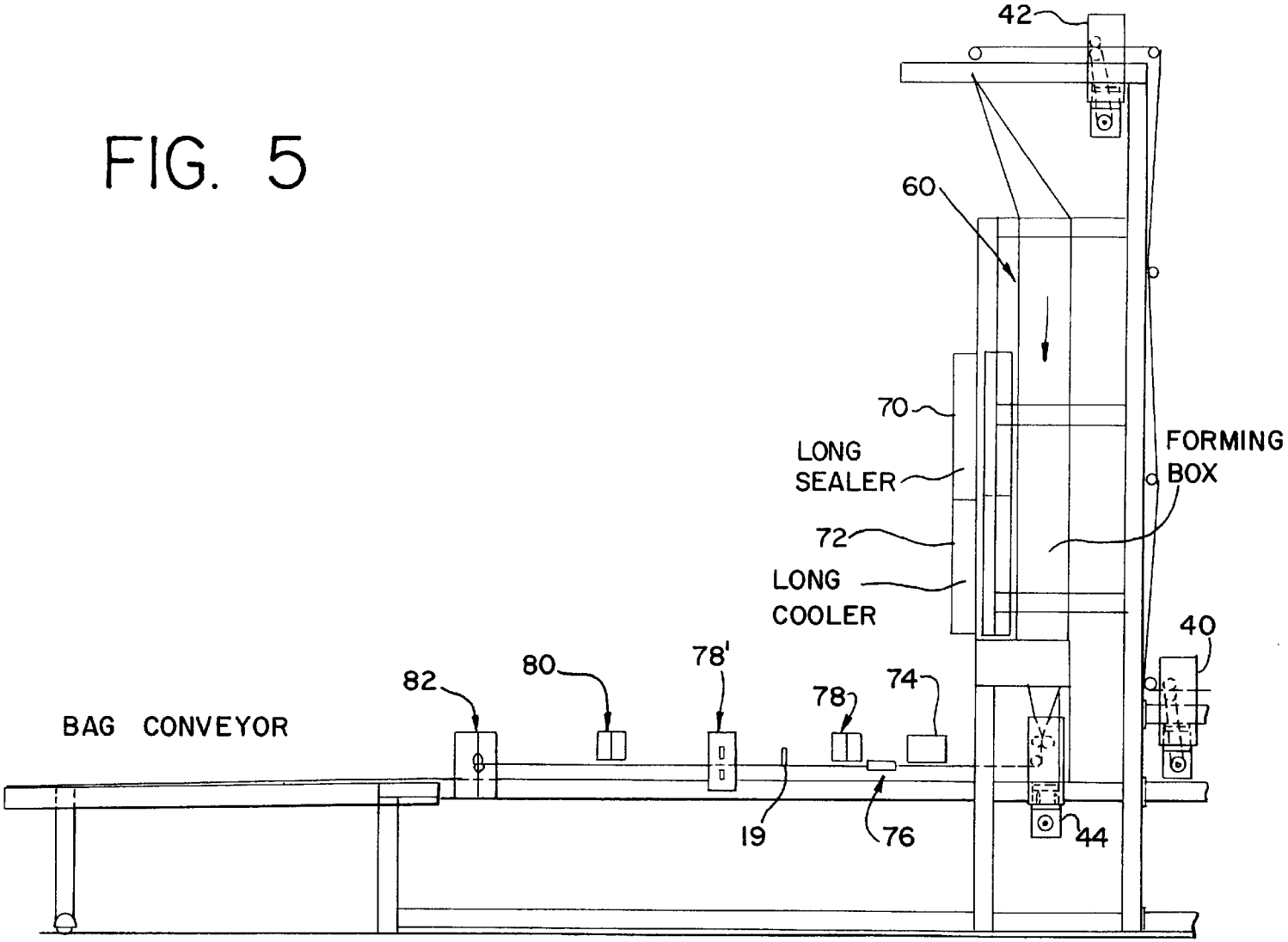
FIG. 5 is a further view of the present apparatus illustrating components of the apparatus which effect formation of the first web of material, with portions of the second web thereon, into a gusseted tube, followed by cross-sealing and severing of the bag assembly being formed.

With particular reference to FIGS. 3, 4, and 5, therein is illustrated bag-making 10 embodying the principles of the present invention. The bag-making apparatus is configured for intermittently advancing a first web of material, which forms the outer bag body, through the apparatus, with spaced-apart portions of the second web of material, each of which forms an inner reinforcement layer, applied to the first web. The first and second webs of material may typically comprise heat-sealable plastic film, but it is within the purview of the present invention that other flexible materials can be employed for one or both of the webs, including paper, plastic-coated paper, and other materials as are known in the art.

The bag-making apparatus 10 includes various stations and mechanisms which effect formation of an internally reinforced bag assembly in accordance with the present invention. In general, the apparatus includes arrangements for supplying the first and second webs of material. The first web of material is directed to a pleat-forming mechanism to "tuck-and-roll" the first web to form a plurality of longitudinally extending pleats or tucks. The apparatus further includes an arrangement for severing portions of the second web of material, and applying each severed portion to the first web so that the portion spans each of the longitudinal pleats in the first web. The portion of the second web is joined to the first web, such as by heat-sealing, with the portion of the second web preferably applied to the first web so that the webs are joined on laterally opposite sides of each of the longitudinally oriented pleats in the first web.

The apparatus 10 includes a forming box assembly along which the first web of material is advanced. The first web of material is guided about an internal forming box of the assembly so that each portion of the second web applied to the first web closely conforms to the exterior of the forming box. Laterally opposite, longitudinal edges of the first web are joined to each other to form a tube, with inwardly extending gussets formed at each side of the tube as the webs are moved through the forming box assembly.

The diagonal or V-shaped square bottom seals are next formed so that the front wall of the bag body being formed is joined to a respective layer of each of the gussets, with the rear wall of the bag body similarly joined to a respective wall of each of the gussets. A transversely-extending end or cross seal is then formed across the tube, with the bag body thus formed severed from the tube for completion of manufacture. The bag bodies are received on a conveyor for subsequent packaging, storage, and shipment.

Specific components of the bag-making apparatus 10 will now be described.

A first outer web of material, designated O, and a second inner web of material, designated I, are respectively supplied from web-supplying mechanisms. The first web of material is supplied from a first web-supplying or "unwind" mechanism 12, which may comprise a dual-station, center-driven mechanism such as a Model 6030, available from Hudson-Sharp Machine Co. of Green Bay, Wis. The inner, second web of material can be provided from an unwind mechanism comprising a 60-inch, dual-station, drag-brake arrangement, also available from the Hudson-Sharp Machine Co.

Each of the first and second webs is pulled into the forming apparatus by a respective dancer-controlled infeed, designated 16 and 18, respectively. This type of infeed is sometimes known as a capstan drive. The dancer is pulled by the downstream demand for web material. As the dancer rises, a voltage signal, relative to the height of the dancer, commands the drive to run at a speed proportional to the dancer's height.

After the webs of material have been introduced into the apparatus, several servo-motor driven nip rolls draw the first web, with portions of the second web thereon, through the apparatus. The exact number of servo motor driven nip rolls can vary, depending on the exact configuration of the apparatus. The web is drawn intermittently and to an exact length which is referred to as the draw cycle. During each draw cycle, the so-called print repeat, that is, the repeated printed graphics typically provided on each of the bag assemblies being formed, is measured (such as by scanners 19) and compared against an entered, or previously measured draw length.

Because of the elasticity of the webs and the variation of elasticity from one kind of web to another (polyethylene, low density polyethylene, laminates, etc.), there are two separate registration functions which are preferably provided. One is on the upstream section of the apparatus, before the forming box assembly. Another is on the downstream section of the apparatus, downstream of the forming box assembly. A dancer between the upstream and downstream sections allows each section to position the web as needed without influencing the other section.

It is known in the art that the repeat length increases gradually throughout the roll of web material, and that the additional length of each draw is cumulative. By way of example, when a bag has increased to 0.010 inches longer than the length at start up, that 0.010 inches 30 bags later downstream is 0.30 inches of phased displacement, with respect to machine components, e.g., the cross-sealer, bag severing device, etc.

The apparatus can be operated in accordance with known print registration algorithnms, such as disclosed in U.S. Pat. No. 5,000,725, hereby incorporated by reference. Both the upstream section and downstream section of the apparatus are the same in this regard.

As noted, the apparatus 10 is divided into an upstream section and a downstream section, with reference to the forming box assembly of the apparatus. The servo driven nip rolls in each section run in ratio to one another to maintain proper tension in the web. Tension is therefore controlled separately in the upstream section and the downstream section of the machine as well as between each set of nip rolls within each section. The ratio between nip rolls is controlled through the operator control panel of the apparatus.

Figure 6:
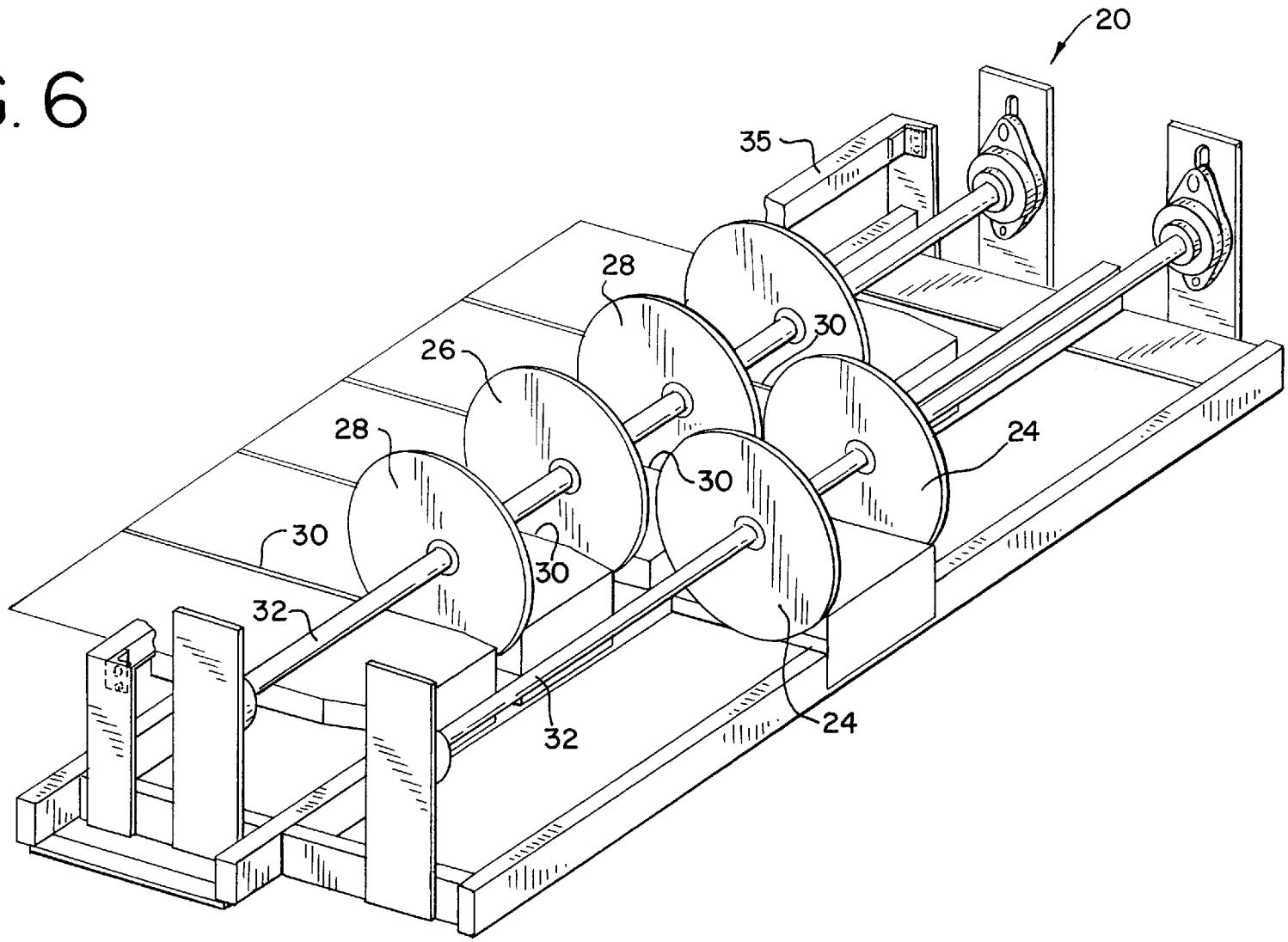
FIG. 6 is a diagrammatic, perspective view of the pleating or "tuck-and-roll" mechanism of the present apparatus for forming a plurality of longitudinal pleats in the first web which forms the outer bag body.
Figure 7:
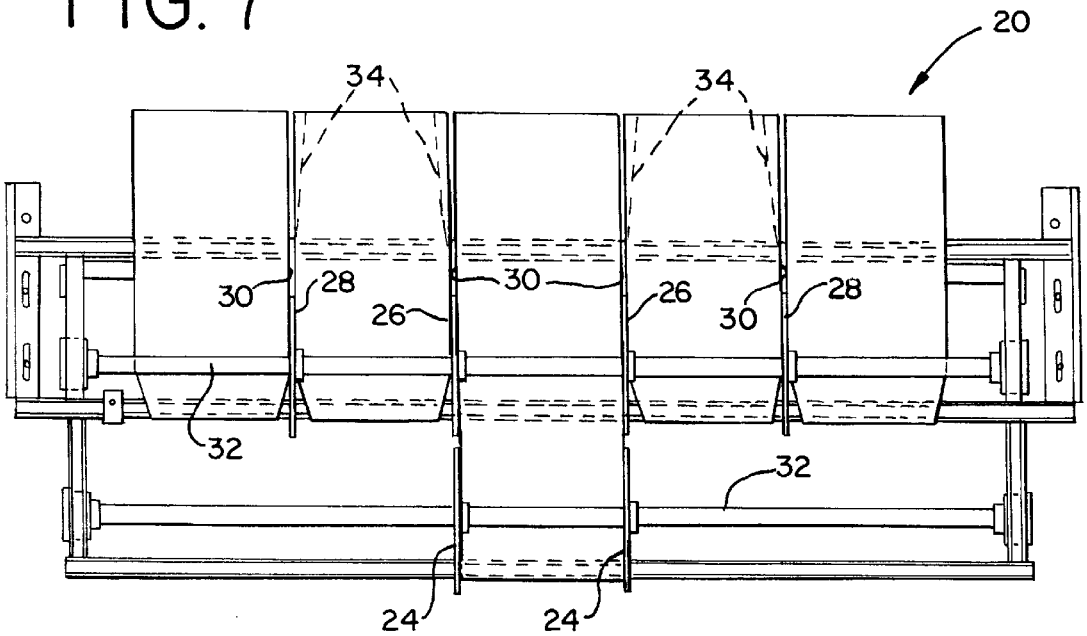
FIG. 7 is a top plan view of the pleating mechanism shown in FIG. 6.
Figure 8:
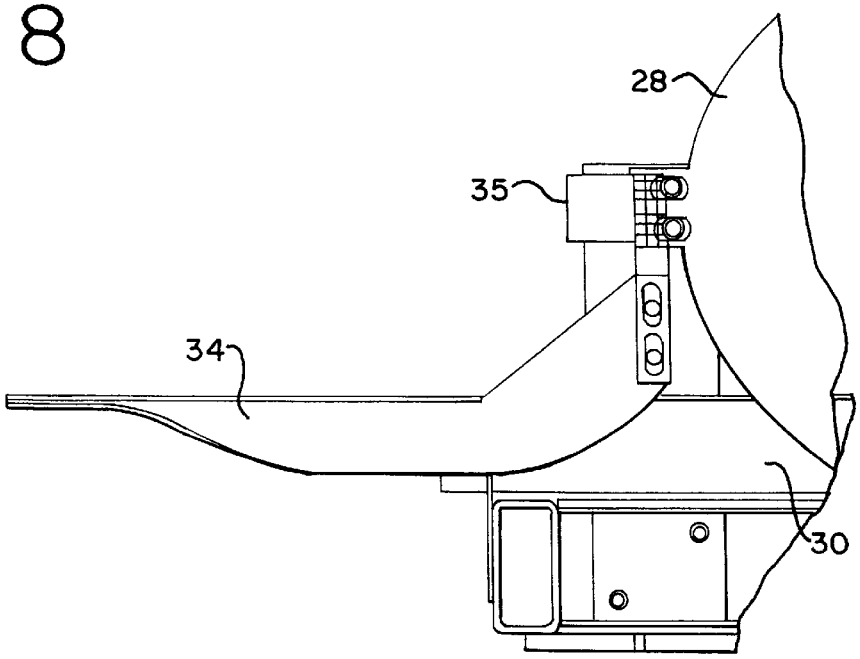
FIG. 8 is a fragmentary, side elevational view of a finger-like pleat guide which is shaped to guide a respective longitudinal pleat from an orientation generally perpendicular to the plane of the first web to an orientation generally parallel to the plane of the first web.

From its respective infeed, the first outer web of material O is directed to a pleat-forming mechanism 20, as illustrated in detail in FIGS. 6, 7, and 8. Formation of an internally reinforced bag assembly in accordance with the present invention requires that the inner reinforcing layer control the bag's layflat formed width and depth dimensions. The inner reinforcing layer is platen sealed to the outer bag body. For the bag assembly to be correct, there must be an equal amount of excess outer web at each corner of the bag. Fastening the outer and inner bag parts so that this corner material is dimensionally correct and folded under to allow it to travel through the process successfully is the purpose of the "tuck-and-roll" step effected by the pleat-forming mechanism 20.

As noted, with the bag assembly of the present invention standing, with product in it, the bag width and depth are determined by the outer wall's dimensions. The outer bag walls tend to bulge out into a round configuration from the pressure of the product. The configuration of the inner wall, platen sealed to the outer wall, prevents the outer walls from bulging outwardly to a round configuration. The filled bag tends to stay square or rectangular depending on the formed dimensions. The length of the outer wall web (the outside of the bag, or the bag body) is some predetermined length longer than the inner wall. The extra length is for proper formation of the bag's square bottom, and to allow enough material for closing the bag top after the bag assembly is filled with product.

The first outer web of material entering the "tuck-and-roll" section of the apparatus is precision tension controlled with the air-loaded dancer in the lower infeed section 16. The web from the dancer passes through an adjustable response edge guide system 21, with the web then passing over a crowned roll or other curved bar 22 to create the necessary slack in the web at both edges to allow tucking or pleating of the web to the required tuck or pleat depth. The web is then advanced to the pleat-forming mechanism 20.

The pleat-forming mechanism 20 includes a plurality of pleat-forming members, preferably provided in the form of free-wheeling (i.e., freely rotatable) wheels or discs. In particular, the mechanism includes an upstream pair of pleat-forming members 24, and two downstream pairs of pleat-forming members, an inner pair 26, and an outer pair 28. The pleat-forming members are mounted in association with a sheet metal table having grooves 30 running in the direction of film travel. There are four grooves 30, each one representing one corner of the bag within which one of four longitudinally oriented pleats or tucks are to be formed in the first web. In a current embodiment, the grooves are approximately 0.3 inches wide, with the pleat-forming members each having a diameter of 8 inches. The pleat-forming members are positioned on respective axles 32, which in a current embodiment, are positioned about 9 inches apart. As will be observed, the pleat-forming members 26 and 28 are positioned to turn within respective ones of the grooves 30, with the mechanism preferably configured to accommodate adjustability of the running depth for varying specifications of bag assemblies.

As the first web of material is moved through the pleat-forming mechanism 20, the upstream pair of members 24 first form a pair of laterally inner pleats or tucks in the first web. This causes the web needed for the two middle pleats or tucks to be pulled inwardly, toward the center of the web, first. As the web moves beneath the downstream pleat-forming members, the inner pair 26 of the downstream members maintain the inner pleats, while the outer pair of members 28 form a pair of laterally outer pleats in the web. By this action, tucking or pleating of the first web is effected.

As illustrated in FIG. 8, a finger-like pleat guide 34 is positioned in respective, operative association with each of the downstream ones 26, 28 of the pleat-forming members by disposition on transverse support 35. Each pleat guide 34 extends into a respective one of the pleats being formed in the web as the pleat moves through and out of the respective groove 30. Each pleat guide has a generally twisted configuration, in a shape such that its proximal portion (positioned in the groove 30) is generally vertically oriented, while its distal portion (positioned beyond the groove 30) is generally horizontally oriented. Each pleat formed in the first web moves along the respective pleat guide, and is thus guided from an orientation generally perpendicular to the plane of the first web to an orientation generally parallel to the plane of the first web. As noted, it is preferred that the laterally inwardly pair of pleats being formed are directed generally away from the centerline of the web, while the laterally outer pair of pleats being formed are directed by the respective pleat guides 34 laterally toward the centerline of the web (see FIG. 1*a*).

Thus, by the configuration of each pleat guide, wherein it is twisted from a vertical to a horizontal configuration beneath the table top of the pleat-forming mechanism, each tuck or pleat starts out vertically within the respective groove 30, and is thereafter oriented generally horizontally, beneath the table after riding along the twist of each of the finger-like pleat guides. This is the "roll" section of the tuck-and-roll manipulation.

As illustrated, the pleat-forming mechanism 20 is positioned at an inclined angle which leads to an inner sheet feed section at which a portion of the second web is applied to the first web. In a current embodiment, the pleat-forming mechanism is approximately 4 feet in length, measured in the direction of web travel.

The bag making apparatus includes an arrangement for severing portions of the second inner web I, and applying each severed portion to the first outer web, so that the inner reinforcement layer of each bag assembly being formed in shorter in length than the length of the bag assembly. The arrangement for effecting severing of portions of the second web will now be described.

As noted, the apparatus 10 includes servo motor drives for intermittently drawing the first web through the apparatus. In the illustrated embodiment, the apparatus includes servo motor drives 40, 42, and 44. For each draw (the feed length) of the first outer web, a length of the inner web is fed out horizontally on top of the outer web by an inner sheet feed 46, which includes an inner layer cutter 48 for severing each portion of the second web prior to application to the first web. This severed portion of the second web provides the inner reinforcement layer of the bag assembly. The length of the inner layer is determined by the specification of the bag assembly. The inner sheet feed 46 includes a servo motor which feeds the length of the inner second web at a ratio less than the servo motor feeding the outer web. At the end of each feed cycle, the portion of the second web forming the inner wall is cut off by cutter 48, and thus severed from the remainder of the second web.

At the end of each feed cycle, an electrostatic discharge apparatus 50 applies a charge to act to adhere the loose inner wall layer to the outer web, and maintain the inner layer in position as the outer web is intermittently advanced. A 20 kilowatt Simco static charger on one side of the first web, and a Simco static eliminator on the opposite side of the web, effect the desired electrostatic treatment. In this manner, the portion of the second web which form the inner reinforcing layer is maintained in position until the first outer web is advanced to the subsequent heat-sealing mechanism. The electrostatic charge desirably eliminates the majority of air between the inner and outer film layers, thus preventing air from getting trapped inside the generally rectangularly shaped platen seal area.

As noted, the inner reinforcing layer of the bag assembly provided by the severed portion of the second web is applied to the first web so that the plurality of longitudinally oriented pleats formed therein are each spanned by the inner reinforcement layer. It is preferred that the inner layer be joined to the outer web at least between each adjacent pair of pleats or tucks, and preferably, on laterally opposite sides of each of the pleats or tucks formed in the first web. The inner layer is preferably joined to the first outer web by heat-sealing, but it is within the purview of the present invention to otherwise join the webs, such as by the use of adhesive.

The apparatus includes a platen sealer 52 and a platen cooler 54 for effecting formation of the seals which join the inner layer of the bag assembly to the outer bag body. Heat seals are formed generally in accordance with the configuration illustrated in FIG. 1*a*, including three (3) generally rectangular seals S and the two (2) laterally outwardly arranged seals S'. Five (5) separate heated seal heads make the seals. Normally, the seals will be rectangular and positioned on what will be the sides of the bag assembly being formed. The three (3) center area platen seals S' are positioned between the tucks in the outer bag body. The platen seals S' on each edge of the web are of a narrower pattern, as illustrated. These seal between the edge of the inner layer and the first tuck at each edge of the outer web.

A platen cooler 54 is located immediately downstream of the platen sealer 52. The platen cooler chills the sealed area of the web with two opposed aluminum plates that are chilled with water circulating through them. These chill plates preferably cycle upwardly and downwardly in unison with the seal platen 52, thus effecting cooling of the seals after they are formed, attendant to each draw cycle of the web as it is intermittently advanced through the apparatus. Dwell time for the various sealing mechanism can be adjusted by suitable controls, thus facilitating use of different bag-making materials.

The bag-making apparatus 10 includes an arrangement for forming the first web of material, with severed portions of the second web thereon, into a gusseted tube, as will now be described.

Figure 9:
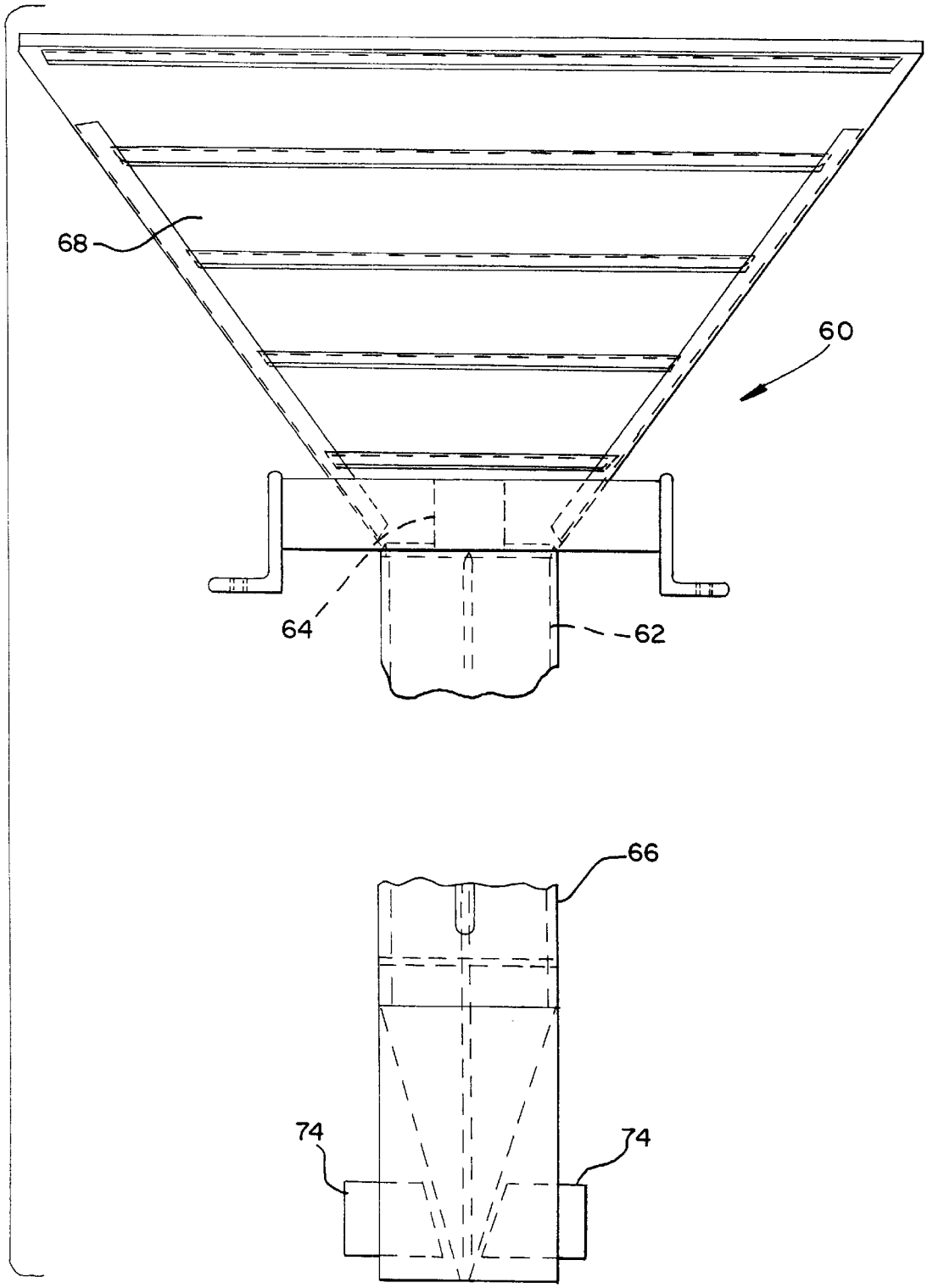
FIG. 9 is a diagrammatic, elevational view of a forming box assembly of the present apparatus which effects formation of a tube from the first web of material having portions of the second web positioned thereon.

Formation of the first web of material into a tube is effected by a vertically oriented forming box assembly 60. The web of material is drawn upwardly along a frame of the apparatus 10 by servo motor drive 42, with the web thereafter guided downwardly generally into and through the forming box assembly. The forming box assembly includes an internal forming box 62, which as illustrated in FIG. 9, is supported by a support 64 so that the forming box extends downwardly within an outer guide box 66 of the assembly. The web of material is trained about a guide horn 68 at the upper extent of the assembly, with the web thereafter guided by the guide box and shaped and formed about the inner forming box 62.

The open web is forced around the inner forming box 62 by the wings and plows of the outer guide box 66. The outer guide box progressively wraps the web around the inner box. Notably, the web is guided such that the portions of the second web, providing the inner layer of the bag assemblies, closely conform to the exterior of the inner forming box. As the inner layer is formed tightly about the inner box, the pleats or tucks in the first outer web now unfold at each of the forming box outer comers as the web progresses down the forming box assembly. Approximately half way down the extent of the forming box assembly, the web has been formed into a quadrangular tube. The laterally opposite, longitudinal edges of the first outer web project from a longitudinal slot defined by the outer guide box 66 and are overlapped, and the overlap sealed to complete the tube. This sealing is effected by a longitudinal seal bar 70 positioned on the exterior of the forming box assembly 60. The longitudinal seal bar effects sealing by a metal-to-rubber sealing interface, with the seal thereafter cooled by a longitudinal cooling bar 72 positioned beneath the seal bar 70. At the end of each draw cycle, the seal bar and the cooling bar are cycled down onto the web together, with the amount of time required to make an adequate seal determined by the web properties, as set by the machine operator. When an overlap seal is formed, the opposite edges of the web are overlapped to seal the completed tube. The tube also can be sealed by a so-called fin seal, wherein the edges of the webs are turned out so that the inside surfaces of the edges of the webs are sealed in confronting relationship to each other.

As noted, the inner reinforcing layer of the bag assembly is preferably narrower than the "tuck-and-rolled" first outer web. This allows the longitudinal seal bar 70 to only seal through two layers of web material to maintain maximum line speeds.

When the web tube reaches the downstream end of the forming box assembly, the sides of the tube are each forced into a gusset by respective gusset plows 74. The gusseted tube is then flattened by a set of nip rolls driven by servo motor drive 44, which pulls the web off of the forming box assembly. The web is then directed from the vertical to the horizontal to complete the formation process.

With particular reference to FIG. 5, formation of the square bottom seal across the tubular web is the next step in the present process. A square bottom seal is known in the art to be a diagonal seal across the gussets of the bag, and thus takes the form of a generally V-shaped seal joining each of the front and rear walls of the bag to a respective layer of each of the bag body gussets (i.e., the front wall is sealed to one-half of each gusset wall, with the rear wall similarly sealed to the other half of each gusset wall). The seal is applied from under the web coming up, and from the top of the web going down, on both sides, essentially simultaneously. A seal pad is mounted so that it rides between the upper and lower layers of each gusset. The result is a gusset sealed together from approximately half the bag depth up the side of the bag diagonally to the middle of the bag, at what will be the bottom of the bag. The orientation of the square bottom seal is such that, where they meet in the bottom of the bag, they form an arrow pointing in the direction of web flow. As will be appreciated, a key aspect of square bottom seal formation is the separation of the four gusset layers (two (2) at each side) with a seal pad to allow sealing the two upper layers, and the two lower layers. Formation of a square bottom seal is not effected properly if all four (4) layers of the gusset are sealed together.

In a current embodiment, a square bottom seal mechanism 74 is provided for forming the desired quare bottom seal. Mechanism 74 may comprise a square bottom sealer as is known in the art.

A square bottom cooler 76 is preferably provided immediately downstream of the square bottom sealer 74. As the web travels during the next web index, the square bottom seal passes over a cooling plate. Chilled air is channeled through the aluminum plate. The channels are directly between the upper and lower square bottom seals. The air is also channeled along the edge of the cooling plate adjacent to the cross seal bar, as will be described. This prevents the cooling plate from heating up due to the radiant heat from the cross seal bars. Padded pressure plates above and below the web keep the film in contact with the cooling plate. As will be appreciated, the desired square bottom seal cooling can alternatively be effected with liquid or ambient air.

One or more cross sealers 78 are positioned downstream of cooler 76 to seal the web across its width at the point where the two angular square bottom seals come together, that is, at the apex of the V-shaped bottom seals. The cross seal or end seal joins and seals all layers of the bag body together and defines the very bottom or lower extent of the bag assembly. The cross sealer 78 includes a set of heated bars closing from above and below the web of material. When operation of the bag-making apparatus is initiated, the upper cross seal bar closes down to a run position about one-eighth inch above the web. The lower bar extends to a run position about one-half inch below the web. The lower bar then cycles once for each bag by extending to lift the web into contact with the upper bar. A standard Fenwall temperature control is used. The dwell time is set by the control system for the apparatus.

In a presently preferred form, there are two (2) separate cross sealers on the apparatus 10, one positioned immediately downstream of the other. This permits the seal formed across the folded tube of the web to be made twice, the first as a "pre-seal", and the second as the finished seal. The second cross sealer is designated 78' in the illustrated embodiment.

The apparatus preferably includes a cross cooler 80 positioned downstream of the second cross sealer 78'. The cooler 80 preferably comprises two aluminum plates, one above and one below the gusseted tubular web. The plates are cooled by liquid circulating therethrough. The cooling plates are preferably extended and retracted with respect to the web, in a manner similar to the actuation of cross sealers 78, 78', to thereby effect cooling of the cross seals which extend across the bag body. This cross seal is designated as end seal ES in FIG. 1*a*. As will be appreciated, formation of the cross seals subsequent to formation of the square bottom seals permits positioning of the square bottom cooling plates generally within the gusseted sides of the tubular web as the web is intermittently advanced past the cooling plates.

The bag-making apparatus 10 includes a cutter 82 for cutting the formed and sealed tube to make individual bag assemblies. The cutting is preferably done by a scissor action, with a spring-loaded upper blade air-actuated downwardly against a lower, fixed anvil blade. As will be appreciated, as the bag assembly is cut from the tube, the portion of the second web applied to the first web provides the desired internal reinforcement of the bag body formed by the first web of material.

The severed bag assembly is fed onto a conveyor, and when cut, drops downwardly onto the pile of cut bags. The conveyor is moving slowly to "shingle", i.e., progressively overlap, the bags. At a predetermined set count, the conveyor will accelerate momentarily to define a group or stack of bags, and then resume its relatively slow advancing motion.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A process of making an internally-reinforced bag assembly, comprising the steps of:

providing a first web of bag-making material for formation of a bag body of said bag assembly;

providing a second web of bag making material for formation of an inner reinforcement layer of said bag assembly;

forming at least one longitudinally oriented pleat in said first web of material;

applying a portion of said second web of material to said first web of material so that said second web spans said pleat in said first web of material;

joining opposite, longitudinal edges of said first web to each other to form a tube, wherein said portion of said second web is positioned on the inside of said tube;

forming a seal across said tube to form one end of said bag assembly; and cutting said tube to separate said bag assembly therefrom, with said portion of said second web providing internal reinforcement of the bag body formed from said first web of material.

2. A process of making an internally-reinforced bag assembly in accordance with claim 1, wherein said step of forming at least one pleat includes forming a plurality of longitudinally-oriented, laterally spaced apart pleats, and said applying step includes applying said portion of said second web to said first web so that said portion spans each of said pleats and is joined to said first web at least between adjacent ones of said pleats.

3. A process of making an internally-reinforced bag assembly in accordance with claim 2, including:

applying said portion of said second web to said first web by joining said portion to said first web on laterally opposite sides of each of said longitudinally-oriented pleats.

4. A process of making an internally-reinforced bag assembly in accordance with claim 2, wherein:

said step of forming a plurality of pleats comprises forming four longitudinally-oriented pleats, including first forming a laterally inner pair of said pleats, and thereafter forming a laterally outer pair of said pleats.

5. A process of making an internally-reinforced bag assembly in accordance with claim 1, including:

severing said portion of said second web from the remainder thereof prior to said applying step, wherein said portion has a length less than the length of said bag body formed by said first web.

6. A process of making an internally-reinforced bag assembly in accordance with claim 1, wherein:

said applying step includes electrostatically maintaining said portion of said second web in position on said first web, and thereafter joining said portion to said first web.

7. A process of making an internally-reinforced bag assembly in accordance with claim 1, including:

forming a pair of gussets in said tube prior to said step of forming a seal.

8. A process of making an internally-reinforced bag assembly in accordance with claim 7, wherein:

said step of forming a seal comprises forming a square bottom seal by forming a V-shaped seal between each of a front and a rear wall of the bag assembly and a respective layer of each of said gussets.

9. A process of making an internally-reinforced bag assembly in accordance with claim 1, wherein:

said step of forming a tube includes providing a tube forming box, and guiding said first web about said forming box so that said portion of said second web closely conforms to the exterior of said forming box.

10. An apparatus for forming an internally-reinforced bag assembly, comprising:

a first web-supplying mechanism for supplying a first web of material for formation of a body of said bag assembly;

a second web-supplying mechanism for supplying a second web of bag-making material for formation of an inner reinforcement layer of said bag assembly;

a pleat-forming mechanism along which said first web is moved for formation of at least one longitudinal pleat in said first web;

an application station for applying a portion of said second web to said first web so that said second web spans said pleat in said first web;

a forming box assembly for forming said first web into a tube, with said portion of said second web being positioned on the inside of said tube, including a sealing mechanism for joining opposite longitudinal edges of said first web to each other;

a sealer former for forming a seal across said tube to form one end of said bag assembly; and a cutter for separating said bag assembly from said tube.

11. An apparatus for forming an internally-reinforced bag assembly in accordance with claim 10, including:

a plurality of drive mechanisms operable in concert with each other for intermittently advancing said first web of material through said apparatus.

12. An apparatus for forming an internally-reinforced bag assembly in accordance with claim 10, wherein:

said pleat-forming mechanism includes a plurality of laterally spaced, pleat-forming members for forming a plurality of longitudinally oriented, laterally spaced pleats in said first web.

13. An apparatus for forming an internally-reinforced bag assembly in accordance with claim 12, wherein:

said pleat-forming mechanism includes an upstream pair of said pleat-forming members, and two downstream pairs of said pleat-forming members, said upstream pair of said members first forming a pair of laterally inner pleats in said first web, an inner pair of said downstream members maintaining said inner pleats, an outer pair of said downstream members forming a pair of laterally outer pleats in said first web.

14. An apparatus for forming an internally-reinforced bag assembly in accordance with claim 13, wherein:

said pleat-forming mechanism includes a pleat guide positioned downstream of each of said inner and outer pairs of downstream pleat-forming members, each said pleat guide having a twisted configuration to guide the respective pleat from an orientation generally perpendicular to the plane of said first web to an orientation generally parallel to the plane of said first web.

15. An apparatus for forming an internally-reinforced bag assembly in accordance with claim 11, wherein:

said application station includes at least one heat-sealer for joining said portion of said second web to said first web on laterally opposite sides of each of said longitudinally-oriented pleats.

16. An apparatus for forming an internally-reinforced bag assembly in accordance with claim 15, including:

an inner layer cutter for severing said portion of said second web prior to application to said first web.

17. An apparatus for forming an internally-reinforced bag assembly in accordance with claim 16, including:

an electrostatic discharge apparatus for electrostatically treating said first web for maintaining said portion of said second web in position on said first web prior to heat-sealing said portion to said first web.

18. An apparatus for forming an internally-reinforced bag assembly in accordance with claim 10, wherein:

said forming box assembly includes an inner forming box, and an outer forming guide positioned about said inner forming box for shaping said first web about said inner forming box so that said portion of said second web closely conforms to the exterior of said inner forming box.

19. An apparatus for forming an internally-reinforced bag assembly in accordance with claim 18, wherein:

said forming box assembly includes a pair of gusset plows for forming inwardly extending gussets at opposite sides of said tube, said sealer including a square bottom sealer for forming a V-shaped seal between each of a front and a rear wall of the bag assembly and a respective layer of each of said gussets.

* * * * *